US010328359B2

(12) United States Patent
Bilbeisi

(10) Patent No.: US 10,328,359 B2
(45) Date of Patent: Jun. 25, 2019

(54) ILLUMINATED ROTATABLE REELS FOR ENTERTAINMENT MACHINES

(71) Applicant: Gamesman Limited, Crawley (GB)

(72) Inventor: Al-Haitham Bilbeisi, Horsham (GB)

(73) Assignee: GAMESMAN LIMITED, Crawley (GB)

( * ) Notice: Subject to any disclaimer, the term of this patent is extended or adjusted under 35 U.S.C. 154(b) by 0 days.

(21) Appl. No.: 16/129,386

(22) Filed: Sep. 12, 2018

(65) Prior Publication Data

US 2019/0076750 A1 Mar. 14, 2019

(51) Int. Cl.
*A63J 13/00* (2006.01)
*G07F 17/32* (2006.01)

(52) U.S. Cl.
CPC ..... *A63J 13/00* (2013.01); *G07F 17/32* (2013.01)

(58) Field of Classification Search
CPC ..... G07F 17/32; A63J 13/00
USPC ..... 472/61
See application file for complete search history.

(56) References Cited

U.S. PATENT DOCUMENTS 6,497,617 B1 * 12/2002 Yoshida ..... G07F 17/32 273/138.1
8,480,474 B2 * 7/2013 Randall ..... G07F 17/32 463/20
9,786,115 B2 * 10/2017 Hirato ..... G07F 17/3213
2004/0132522 A1 * 7/2004 Seelig ..... G07F 17/3211 463/16
2009/0017903 A1 * 1/2009 Mizoguchi ..... G07F 17/3202 463/20
2009/0143134 A1 * 6/2009 Anderson ..... G07F 17/32 463/20
2010/0113125 A1 * 5/2010 Bernard ..... G07F 17/3202 463/20
2012/0115569 A1 * 5/2012 Fujisawa ..... G07F 17/3213 463/20
2012/0309490 A1 * 12/2012 Okada ..... G07F 17/3244 463/20
2014/0312565 A1 * 10/2014 Sato ..... G02B 5/0278 273/142 R

FOREIGN PATENT DOCUMENTS

JP 2002035204 2/2002
JP 2002221842 8/2002
JP 2003265682 9/2003
JP 2004057593 * 2/2004 ..... A63J 13/00

(Continued)

OTHER PUBLICATIONS

Search Report issued in related foreign patent application GB1814838.7, dated Feb. 20, 2019, 4 pages.

*Primary Examiner* — Michael D Dennis
(74) *Attorney, Agent, or Firm* — Gavin J. Milczarek-Desai; Quarles & Brady LLP

(57) ABSTRACT

A rotatable reel 100 for an entertainment machine comprises a circumferential lateral surface 101 and an internal frame structure 102. The reel 100 is provided with illumination means 110. The illumination means 110 are provided in a circumferentially mounted row, the row aligned with the direction of rotation about the central axis X. The illumination means 110 are activated by an illumination control unit at frequencies related to the rotation frequency of the rotatable reel 100 about central axis X.

30 Claims, 10 Drawing Sheets

(56) References Cited

FOREIGN PATENT DOCUMENTS

| | | | | | |
|---|---|---|---|---|---|
| JP | 2004057593 | A | | 2/2004 | |
| JP | 2004147789 | | | 5/2004 | |
| JP | 2004298471 | | | 10/2004 | |
| JP | 2006061532 | | * | 3/2006 | ..... A63J 13/00 |
| JP | 2006061532 | A | | 3/2006 | |
| JP | 2006158768 | | | 6/2006 | |
| JP | 2009055939 | | | 3/2009 | |
| JP | 2013158603 | | | 8/2013 | |

* cited by examiner

ILLUMINATED ROTATABLE REELS FOR ENTERTAINMENT MACHINES

TECHNICAL FIELD OF THE INVENTION

The present invention relates to entertainment machines and to illuminated rotatable reels for entertainment machines. More particularly, the present invention relates to the production of visual effects on rotatable reels housed within said entertainment machines and to the reel adaptions to produce such visual effects.

BACKGROUND TO THE INVENTION

Entertainment machines typically house one or more reels which rotate on a common horizontal axis. The user may see a portion of the reel through a viewing window provided in the external housing of the machine. The reel typically comprises an internal framework commonly referred to in the art as a basket and a circumferential lateral surface. The lateral surface of the reel is provided with equally spaced symbols. The reel rotation is stopped by user interaction, commonly the press of a button. The user interaction results in a stop procedure in which the spinning reels are brought to rest. The reel is bought to rest such that the selected symbols are brought into precise alignment with a win line. Typically the win line is located centrally within a viewing window. A few symbols adjacent to the win line may also be visible.

Reel entertainment machines are often provided with eye-catching decorative features to attract the attention of potential users. Logically, the more aesthetically creative the decorative features, the more attention the entertainment machine will draw.

It is an object of the present invention to provide eye-catching decorative features for a rotatable reel for an entertainment machine in order to attract more users and increase user engagement.

SUMMARY OF THE INVENTION

According to a first aspect of the present invention, there is provided a rotatable reel for an entertainment machine, characterised in that the reel is provided with at least one row of circumferentially mounted illumination means, the row aligned with the direction of rotation, wherein the illumination means are operable to be activated at intervals related to the reel rotation frequency.

By varying the activation duration and frequency of the illumination means, numerous static, rotating and counter-rotating visual effects may be produced. The rotating illumination means provide a moving source of light which may be perceived as a light trace. These effects are advantageous as they act to entertain the user. These effects may also draw a potential user's attention more strongly to the entertainment machine which may result in an increased likelihood of the potential user using the entertainment machine.

The illumination means may comprise incandescent light bulbs, lasers or any other suitable means of illumination. The illumination means may comprise light emitting diodes (LEDs). The illumination means may be monotone. The illumination means may comprise two different monotone illumination means. The illumination means may comprise a plurality of different monotone illumination means. In a preferred embodiment, the illumination means may comprise a set of RGB LEDs.

The reel may comprise an internal framework and a circumferential lateral surface. The illumination means may be mounted to the framework of the reel. The illumination means may be mounted to the outer rim of the framework of the rotatable reel. The illumination means may be housed within the framework of rim of the rotatable reel. In such embodiments, the illumination means may be countersunk into the framework of the rim. The illumination means may be mounted to the inner rim of the framework of the rotatable reel. The illumination means may be mounted to a spoke of the internal frame work.

The illumination means may be mounted to the lateral surface of the reel. The illumination means may be mounted to or above the outer lateral surface of the reel. Illumination means mounted above the lateral surface may produce the effect of floating above the lateral surface. The illumination means may be mounted within the lateral surface of the reel. In such embodiments, the illumination means may be laminated between the layers of material which comprise the lateral surface of the reel. The illumination means may be mounted to the inner lateral surface of the reel.

The illumination means may be provided with light directing means for directing emitted light on to the lateral surface of the reel. The light directing means may comprise one or more mirrors, lenses, optical fibres or the like or a combination thereof. The lateral surface of the reel may be adapted in such a way as to allow the propagation of light from the illumination means, through the lateral surface. The adaptation may be a transparent section of the lateral surface of the reel. The adaptation may be a translucent section of the lateral surface of the reel. The lateral surface of the reel may be provided with a transparent window through which light from the illumination means may propagate. The lateral surface of the reel may be provided with an aperture through which light from the illumination means may propagate.

There may be a single row of illumination means present upon a reel. The row may be provided on one peripheral edge of the reel. There may be two or more rows of illumination means present upon a reel. The rows may be provided on opposing peripheral edges of the reel.

The illumination means on each row may be substantially evenly spaced around the circumference of the reel. The number of illumination means provided on the or each row may be determined by the size of the reel and the expected rotation rate. For a typical reel used in a gaming machine, there may be 22 illumination means in the or each row for an expected maximum rotation rate of 150 revolutions per minute.

The activation of the illumination means may be controlled by an illumination control unit. The illumination control unit may comprise a microprocessor. The control unit may be mounted external to the reel. The illumination control unit may be mounted within the main body of the entertainment machine, external to the reels. The illumination control unit may be mounted to the reel.

The illumination control unit may activate the illumination means at a frequency equal to the determined reel rotation frequency. The illumination control unit may activate the illumination means at a frequency greater than the determined reel rotation frequency. The illumination control unit may activate the illumination means at a frequency lesser than the determined reel rotation frequency.

The illumination control unit may vary the activation duration of the illumination means in response to the reel rotation frequency. The illumination control unit may vary the activation duration of the illumination means in relation to the rate of change of the reel rotation frequency.

The illumination means may have a minimum activation duration. The minimum activation duration may be determined with reference to the temporal sensitivity of the human eye. As the human eye takes time to react to variation in incident light, when activated and in motion, the illumination means sources can form the impression of a trace to a viewer's eye. This latency of image that helps create the pleasing visual effect of the present invention.

The timely activation of the illumination means results in visual effects dependent upon their activation frequency relative to the rotation frequency of the reel. Should these frequencies be the same, the resultant visual effect may be an apparently static light source. Should the activation frequency be fractionally greater than the rotation frequency of the reel, a light trace will appear to rotate in the same direction as the rotation of the reel. Should the activation frequency be fractionally lesser than the rotation frequency of the reel, a light trace will appear to counter rotate relative to the direction of rotation of the reel.

The illumination means may be separated into groups. The illumination control unit may activate each group independently. A group may comprise a single illumination means. A group may comprise two or more illumination means. The illumination means in each group may be activated simultaneously. Each group may be activated at the same rotation frequency as the frequency of rotation of the reel. Each group may be activated at a frequency greater than the rotation frequency of the reel. Each group may be activated at a frequency lesser than the rotation frequency of the reel.

Power may be delivered to the reel illumination from a power supply external to the reel. Power may be delivered to the reel illumination from a power supply within the entertainment machine. In such embodiments, power may be delivered to the rotatable reel via any suitable power transfer means. In particular, the power transfer means may be a slip ring, rotary coupling, wireless transfer device or the like. If the power transfer means is a slip ring, it may comprise brushes.

Power may be delivered to the rotatable reel illumination via two or more power transfer means. Each power transfer means may activate a group of illumination means independently. Each power transfer means may simultaneously activate two or more groups of illumination means.

Data may be transferred through the power transfer means. Illumination control signals may be transferred through the power transfer means.

The power supply output may be connected to the illumination means. The power supply output may be varied in response to the illumination control unit. The peak power output of the power supply may be varied in response to the illumination control unit. The power supply may be pulse-width modulated. The illumination control unit may vary the duty cycle of the power supply output. The output light intensity of the illumination means may be varied in response to the illumination control unit.

The illumination control unit may be operable to determine the reel rotation frequency. The reel may be provided with one or more rotation sensors operable to detect reel rotation. The illumination control unit may process data from said rotation sensors to determine the rotation frequency of the spinning reel. The rotation sensors may comprise any one or more of: a magnetic sensor, a Hall-effect sensor, an accelerometer, an optical sensor, an infrared sensor, an ultraviolet sensor, a mechanical sensor or any other suitable sensor. The illumination control unit may drive the illumination means in response to the reel motor drive frequency.

According to a second aspect of the present invention there is provided an entertainment machine characterised in that it comprises at least one rotatable reel in accordance with the first aspect of the invention.

The entertainment machine of the second aspect of the invention may include any or all features of the first aspect of the invention, as desired or appropriate.

Preferably, the entertainment machine comprises two or more rotatable reels where each reel is a reel according to the first aspect of the present invention.

Each reel may display different visual effects. The reels may display the same visual effects. The reels may display complementary visual effects.

An illumination control unit may control illumination for a single reel. An illumination control unit may control illumination for a plurality of reels. The illumination control for the reels may be coordinated by a central entertainment control unit. The central entertainment control unit may synchronise visual effects between reels.

By comparing the rotation frequencies of each spinning reel and comparing these frequencies with the desired visual effect, paired visual effects may be produced across a plurality of spinning reels. The interaction of the visual effects may draw a potential user's attention more strongly to the entertainment machine which may result in an increased likelihood of the potential user using the entertainment machine.

According to a third aspect of the present invention there is provided a method of operating a rotatable reel in accordance with first aspect of the invention, the method comprising the steps of: determining the rotation frequency of the spinning reel; and activating the illumination means at intervals related to the rotation frequency of the spinning reel.

Methods of the third aspect of the present invention may include any or all features of the first and second aspects of the invention, as desired or appropriate.

The method may involve determining the reel rotation frequency. This may be achieved by one or more rotation sensors operable to detect reel rotation. The method may involve processing data from said rotation sensors to determine the rotation frequency of the spinning reel. The method may involve determining the reel rotation frequency from the reel motor drive signal. This allows reel rotation to be inferred based on knowledge of the drive signals required to control the reel rotor. The method may include determining an expected reel rotation frequency based on pre-set data. The expected reel rotation frequency may be fixed or may vary. The pre-set data may comprise a ramp table or the like.

The method may involve activating the illumination means at a frequency equal to the determined reel rotation frequency. The method may involve activating the illumination means at a frequency greater than the determined reel rotation frequency. The method may involve activating the illumination means at a frequency lesser than the determined reel rotation frequency. The method may involve varying the activation duration of the illumination means in relation to the rate of change of rotation frequency of the spinning reel.

The method may involve varying the duration of activation of the illumination means in response to the determined reel rotation frequency.

The method may involve activation of individual illumination means. The method may involve the simultaneous activation of a plurality of illumination means.

According to the fourth aspect of the present invention there is provided a method of operating an entertainment machine comprising multiple reels in accordance with the first and second aspects of the invention, the method comprising the steps of: determining the rotation frequency of the spinning reels; and activating the illumination means at intervals related to the rotation frequency of the spinning reels.

Methods of the fourth aspect of the present invention may include any or all features of the first, second and third aspects of the invention, as desired or appropriate.

The visual effects may be different on each spinning reel. The visual effects may be the same on each spinning reel. The visual effects may be complimentary across spinning reels.

The visual effects may be paired across adjacent reels.

DETAILED DESCRIPTION OF THE INVENTION

In order that the invention may be more clearly understood one or more embodiments thereof will now be described, by way of example only, with reference to the accompanying drawings, of which:

Figure 1:
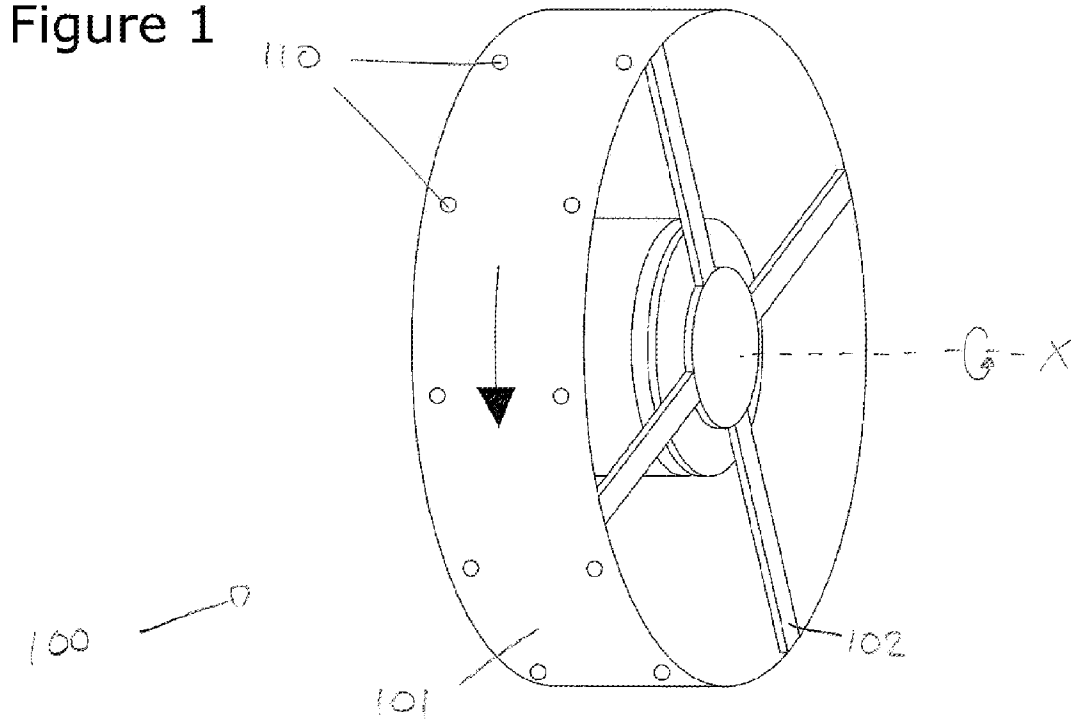
FIG. 1 is a perspective view of one embodiment of a reel according to the invention.

FIG. 1 shows a rotatable reel 100 for an entertainment machine. The rotatable reel 100 comprises a circumferential lateral surface 101 and an internal frame structure 102 known in the art as the basket. The internal frame structure 102 provides support for the lateral surface 101, allowing the reel 100 to rotate about a central axis X.

The reel 100 is provided with illumination means 110. The illumination means 110 are provided in a circumferentially mounted row, the row aligned with the direction of rotation about the central axis X. Typically, the illumination means 110 are mounted on or over lateral surface 101. Alternatively, the illumination means could be mounted to the frame 102.

The illumination means 110 are activated by an illumination control unit (not shown in FIG. 1). The illumination control unit activates the illumination means 110 at frequencies related to the rotation frequency of the rotatable reel 100 about central axis X. Shown in FIG. 1 is the light trace resultant of an activation frequency of the illumination means 110 set to the rotation frequency of the rotatable reel 100 about central axis X. Shown in FIG. 1 is a stationary point light trace. The illumination control unit may activate the illumination means 110 for a greater duration at the same frequency. This would result in an elongated stationary trace.

The rotation frequency may be determined by processing the data received from an array of rotation sensors, or by processing the reel's 100 motor drive frequency.

Figure 2:
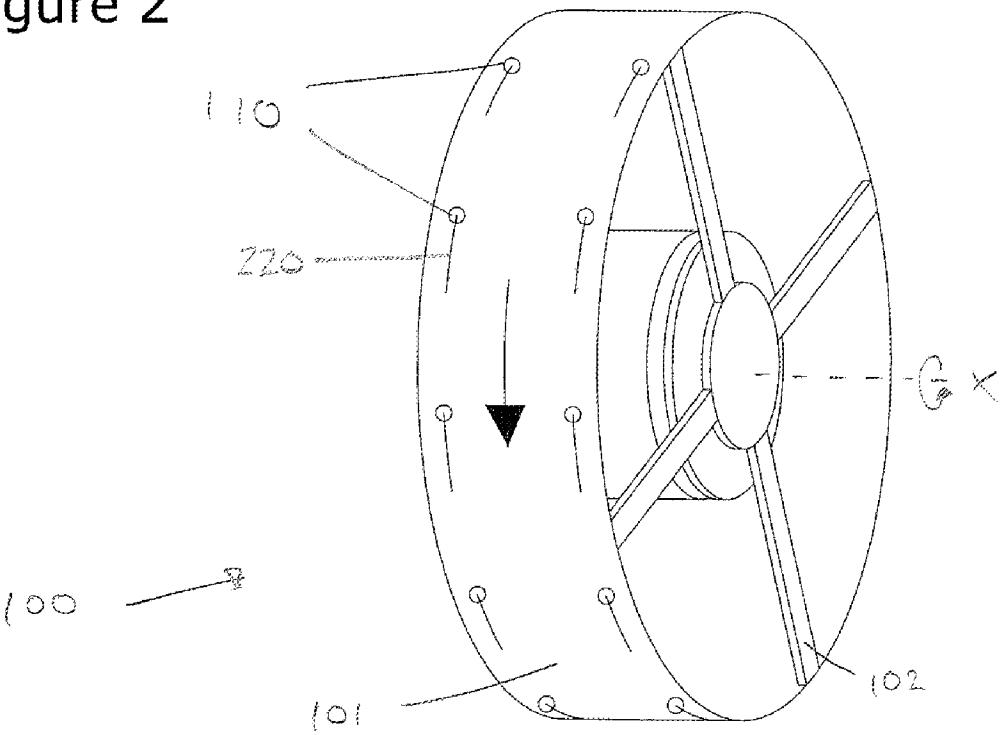
FIG. 2 is a perspective view of the reel of FIG. 1, showing light traces.

FIG. 2 shows light trace 220. The illumination control unit activates the illumination means 110 at a frequency slightly greater than the rotation frequency of the spinning reel 100 about the central axis X. The resultant light trace 220 appears to rotate slowly in the direction opposing the rotation of the spinning reel 100 about the central axis X.

Figure 3:
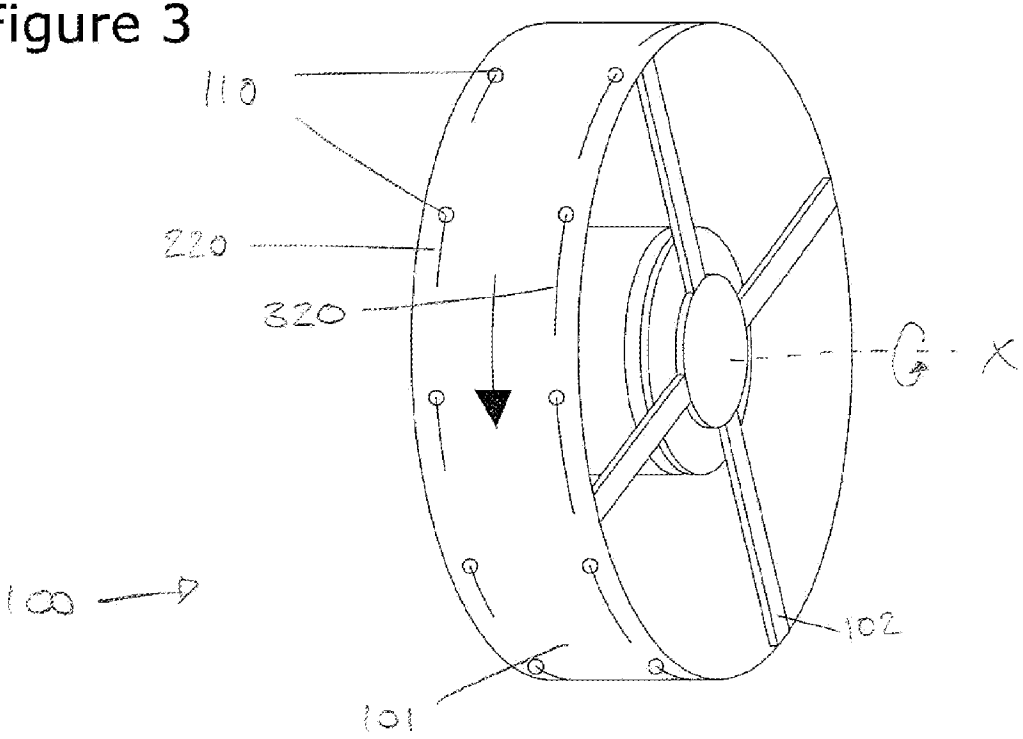
FIG. 3 is a perspective view of the reel of FIG. 1, showing differing light trace lengths.

FIG. 3 shows light trace 220, identical to that shown in FIG. 2. FIG. 3 also shows light trace 320. The illumination control unit activates illumination means 110 on the right hand side of the lateral surface 101 of the spinning reel 100 at a slightly greater pulse length than that of the illumination means 110 on the left hand side of the lateral surface 101. The resultant light trace 320 appears to be longer, relative to the left hand side trace 220. FIG. 3 shows the activation of illumination means 110 at different pulse lengths.

Figure 4:
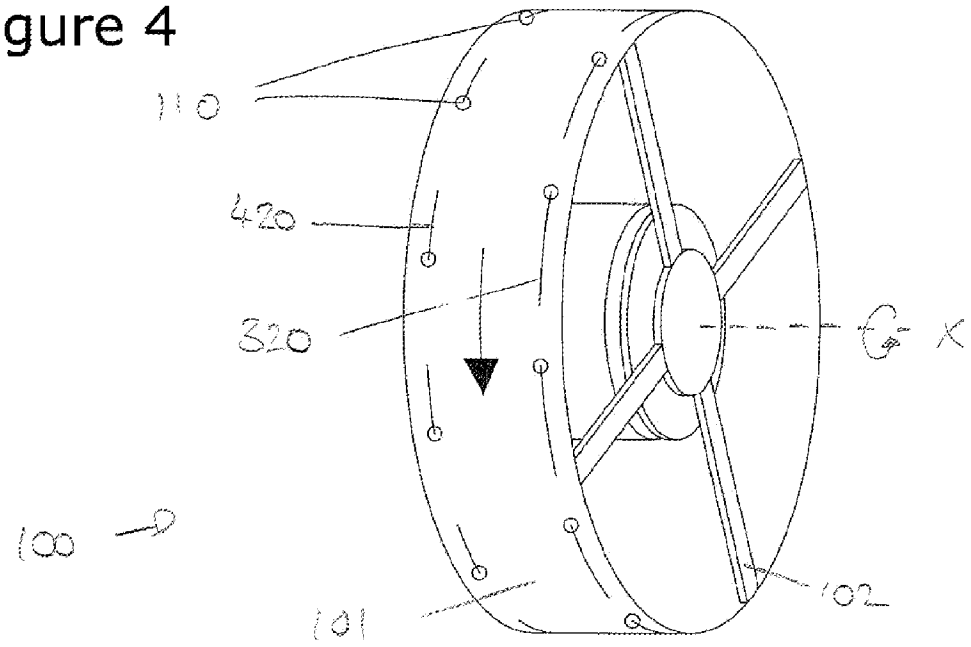
FIG. 4 is a perspective view of the reel of FIG. 1, showing counter rotating light traces.

FIG. 4 shows light trace 320, identical to that shown in FIG. 3. FIG. 4 also shows light trace 420. The illumination control unit activates illumination means 110 on the left hand side of the lateral surface 101 of the spinning reel 100 at slightly lesser frequency than that of the rotation frequency of the spinning reel 100 about central axis X. The resultant light trace 420 appears to rotate slowly in the direction of the rotation of the spinning reel 100 about central axis X. The direction, speed and lengths of light traces 320 and 420 appear different due to the difference in magnitude of their respective differences to the spinning reel 100 rotation frequency and pulse durations. FIG. 4 shows the activation of illumination means 110 on different sides of the lateral surface 101 at different frequencies both lesser and greater than the spinning reel 100 rotation frequency as well as at different pulse durations.

Figure 5:
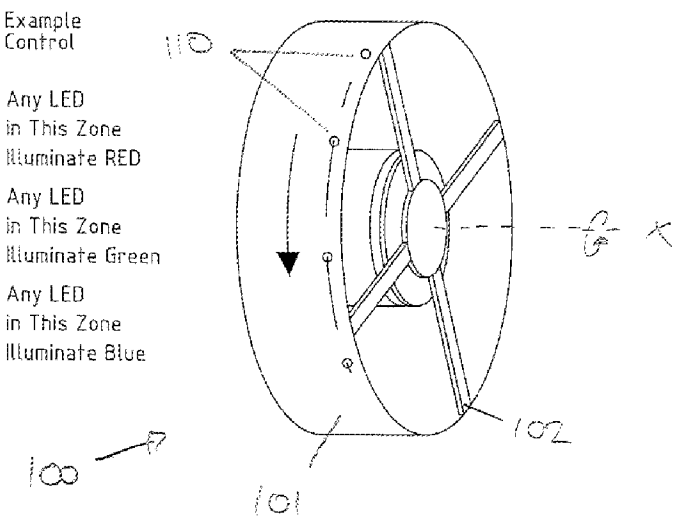
FIG. 5 is a perspective view of the reel of FIG. 1, showing how groups of illumination means may be activated for certain regions of reel rotation.

FIG. 5 shows an example of how groups of coloured illumination means 110 may be activated to produce light traces for certain portions of the spinning reel 100 rotation about central axis X. The coloured illumination means 110 may comprise RGB LEDs. With RGB LEDs a large selection of colours can be produced in response a signal driving each red, green and blue LED. In this example, the upper zone is zone 1, middle zone is zone 2 and lower zone is zone 3. Each zone is represented by a different colour of illumination means activation, as indicated in FIG. 5. FIG. 5 illustrates zone 1 to be illuminated red, zone 3 as green and zone 3 as blue. The skilled person would appreciate that this is not a limitation but merely an example illumination pattern. With RGB LEDs a wide variety of illumination patterns are possible, not limited to the constituent LED colours: red, green and blue. The illumination control unit activates groups of illumination means 110 at frequencies equal to the rotation frequency of the spinning reel 100 about the central axis X for duration appropriate to illuminate only the corresponding zone for each group. This is advantageous as the users attention can be drawn to easily to the central win line.

The illumination control unit may activate the illumination means 110 at a frequency slightly lesser or greater than that of the spinning reel rotation frequency in order to produce the visual effect of the zones being cycled, counter rotating or rotating with the rotation of the spinning reel 100 respectively.

The duration of illumination means 110 activation may be increased to produce an overlap in zones, or reduced to produce an absence of illumination means 110 activation between zones. The illumination control means may also vary frequency of illumination means 110 activation simultaneously with activation duration in order to reduce or increase the number of zones visible to the user.

Figure 6:
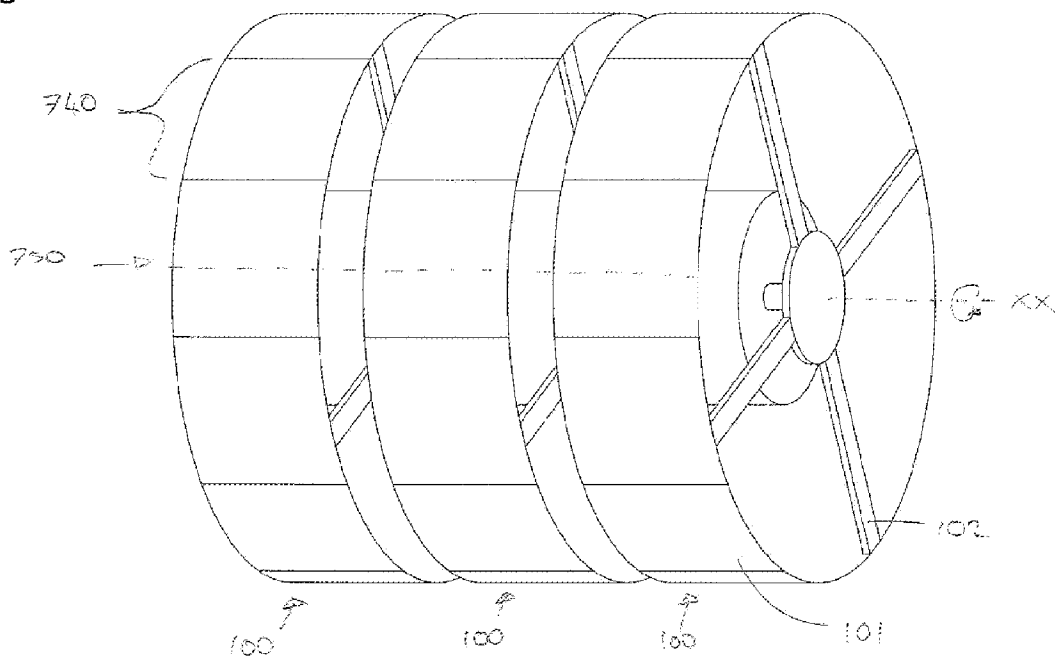
FIG. 6 is a perspective view of multiple reels, according to the present invention, arranged as in an entertainment machine.

FIG. 6 shows multiple adjacent reels 100 which may freely rotate about common central axis XX. Each reel has a circumferential lateral surface 101 and an internal supporting framework 102, as in FIGS. 1-5. In FIG. 6, the lateral surface 101 has been segmented into sectors 740 to show how symbols are arranged on entertainment machine rotatable reels 100. Typically, there is a single symbol per sector. In entertainment machines, commonly (although not limited to) three symbols per reel 100 are visible to the user through a viewing window in the body of the entertainment machine. FIG. 6 shows the rotatable reels in their rest state, where symbols are aligned to a win line 750. The win line 750 is typically located centrally within the viewing window of the entertainment machine.

Illumination grouping shown in FIG. 5 may be used to draw the user's attention more strongly to the win line 750 as shown in FIG. 6.

Figure 7:
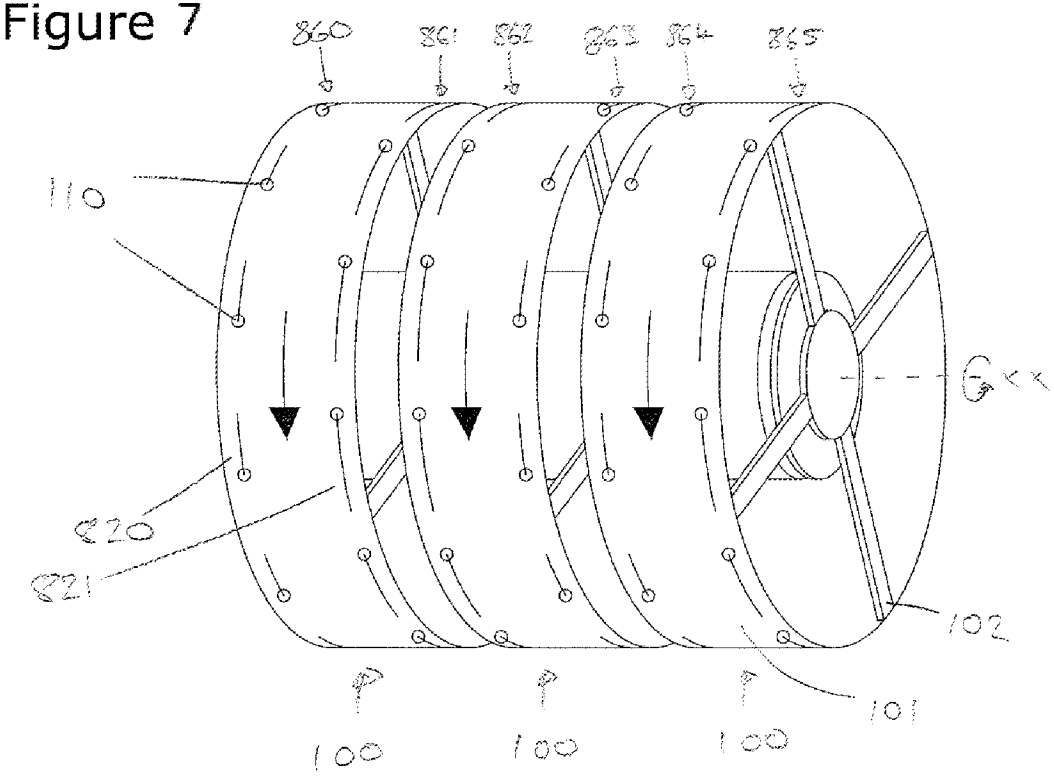
FIG. 7 is a perspective view showing the pairing of effects across multiple reels as seen in FIG. 6.

FIG. 7 shows a pairing effect across the multiple reels. Reels 100 are rotating in the same direction about common central axis XX. The reels are provided with illumination means 110 located at the edges of each reel 100. Illumination means 100 located on the right hand side of the left most reel 861 are paired with illumination means 100 located on the left hand side of the central reel 862. A central illumination control unit determines the rotation frequency of each reel and sets the activation duration, frequency and intensity of each reels illumination means 100 to result in paired effects across reels, regardless of the individual rotation frequency of each reel 100.

In the simplistic example shown in FIG. 7, rotating 820 and counter rotating 821 light traces paired between spinning reels 100.

Figure 8:
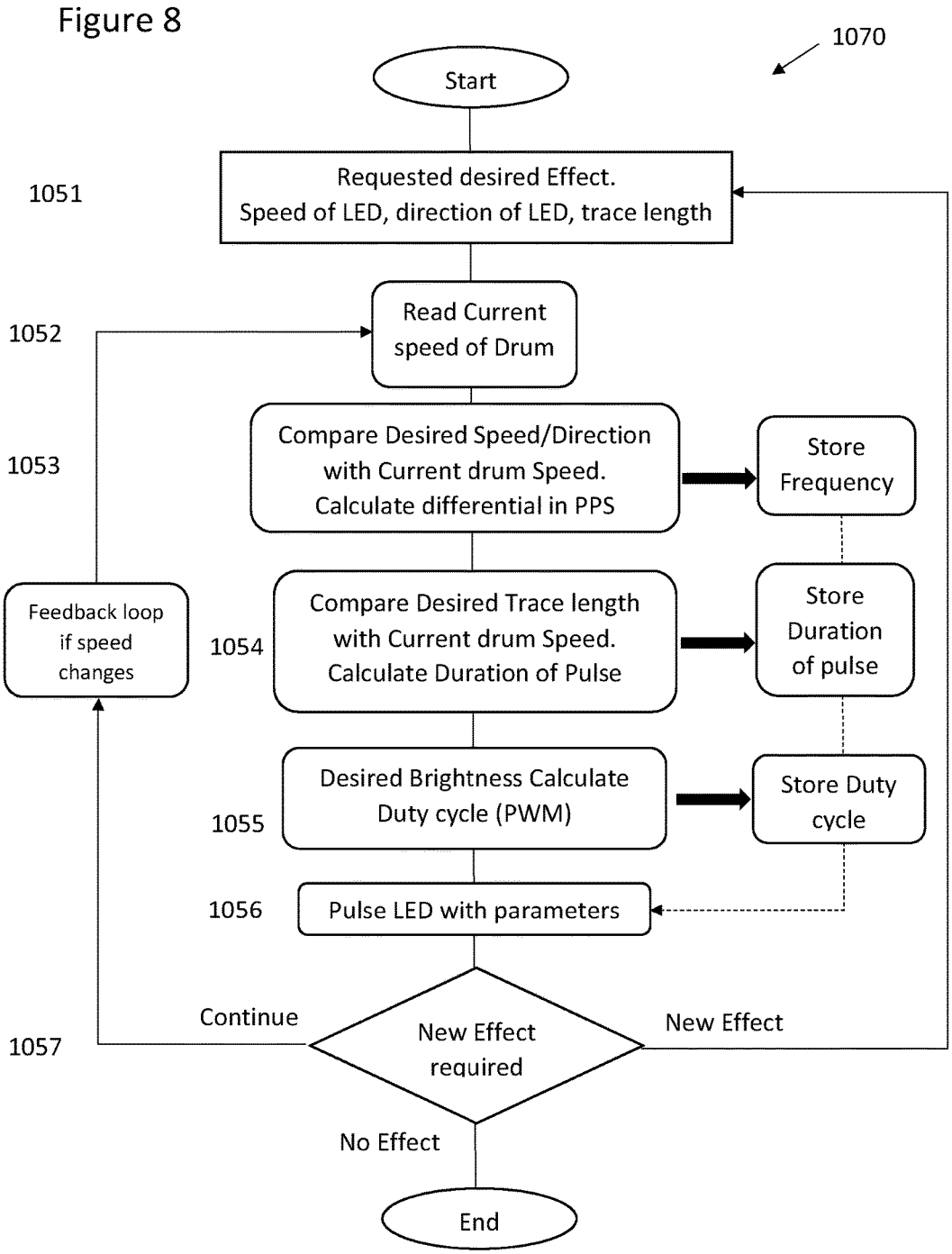
FIG. 8 is a logic diagram showing control of illumination means to output trace effects using varying frequency and pulse lengths.

FIG. 8 shows a schematic illumination control logic diagram 1070. This logic diagram 1070 may be applied to control the illumination means 110 present upon single or multiple reels 100 so as to provide static, rotating or counter rotating effects as illustrated in FIGS. 2-5.

The illumination control unit queries the desired effect in 10S1, receiving the desired speed, direction and trace length data. The current reel rotation frequency is then read in 10S2. In 10S3 a comparison is made between the desired effect movement speed and the current rotation speed in order to calculate an appropriate activation frequency for the illumination means 100, which is then stored. In 10S4 a comparison between the desired trace length and the current rotation speed is made in order to calculate an appropriate pulse duration, which is then stored. In 10S5 a calculation of the illumination means activation intensity is made in order to produce the desired brightness, this data is then stored. In 10S6 the calculated frequency, duration and intensities are combined and passed from the illumination control unit to the power supply to the illumination means 110 resulting in the visual effect. A feedback loop ensures that the effect remains present upon the reels 100 in the case of a change in reel rotation frequency. In 10S7 the logic diagram allows anew effect to be entered. The logic diagram 1070 terminates when the current effect and no new effect are desired.

Whilst the example of FIG. 8 illustrates the use of a feedback loop, the skilled man will appreciate that this is not compulsory. The feedback loop can be omitted and the frequency and duration of pulses can be set based on an expected rotation rate. In such embodiments, the expected rotation rate may be based on a pre-set desired rotation rate for operation or may be based on the reel motor driving signal. In this way, the signals used to control reel rotation can be used to determine the expected reel rotation speed and hence control the illumination means. In embodiments omitting a feedback loop, during expected variations in reel rotation frequency, for instance as the reels accelerate at the start of a cycle or decelerate at the end of a cycle, the illumination means may be controlled in response to a ramp profile. The ramp profile varies illumination in a stepwise or linear progression based on the expected variation of the reel rotation speed. A suitable present ramp profile can allow illumination activation frequencies and durations to vary at an approximate match to the acceleration/deceleration of a reel. This enables reel effects as described above to be applied to accelerating/decelerating reels without adding reel rotation sensors and a feedback loop. This facilitates the use of the present invention with less sophisticated gaming machine architecture.

Figure 9:
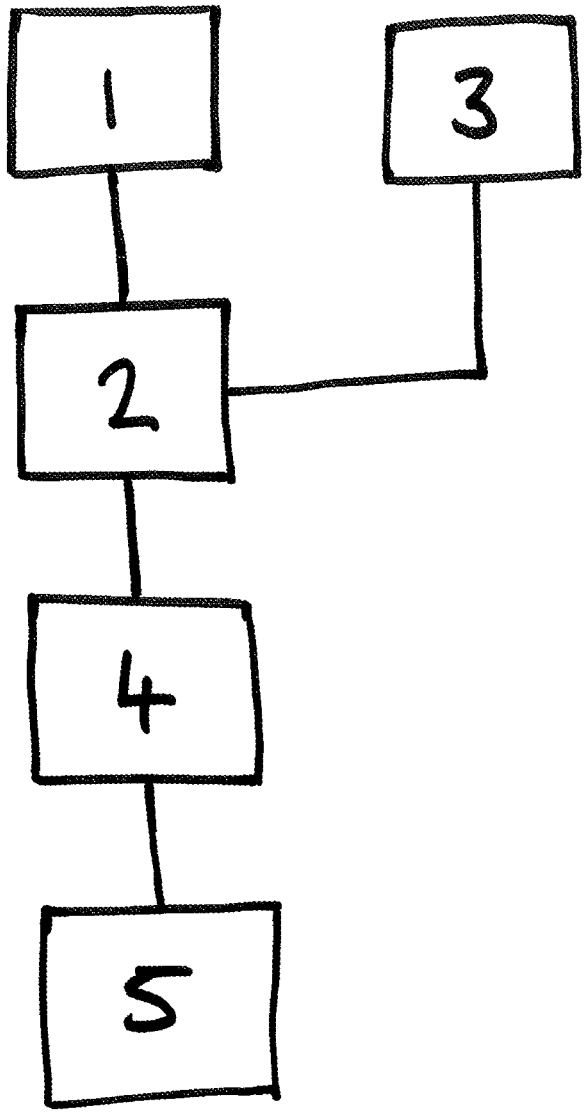
FIG. 9 is a block circuit diagram showing the systems used to control illumination means on an individual reel, as seen in FIG. 1.

FIG. 9 shows an example block circuit diagram used for illumination means 110 control for individual rotatable reels 100, as shown in FIG. 1. The reel rotation data is determined by an array of rotation determining means 1, such as rotation sensors or directly via processing the reel motor drive frequency. This data is then passed to the illumination control unit 2. The desired effect is passed by the entertainment machine system control unit 3 to the illumination control unit 2. The illumination control unit 2 determines the illumination frequency, duration, colour and duty cycle data which is then sent to the illumination drive circuit 4, providing a power supply to the illumination means 110. The illumination drive circuit 4 then provides power, in response to the illumination data received from the illumination control unit 3, to the illumination means 5.

Figure 10:
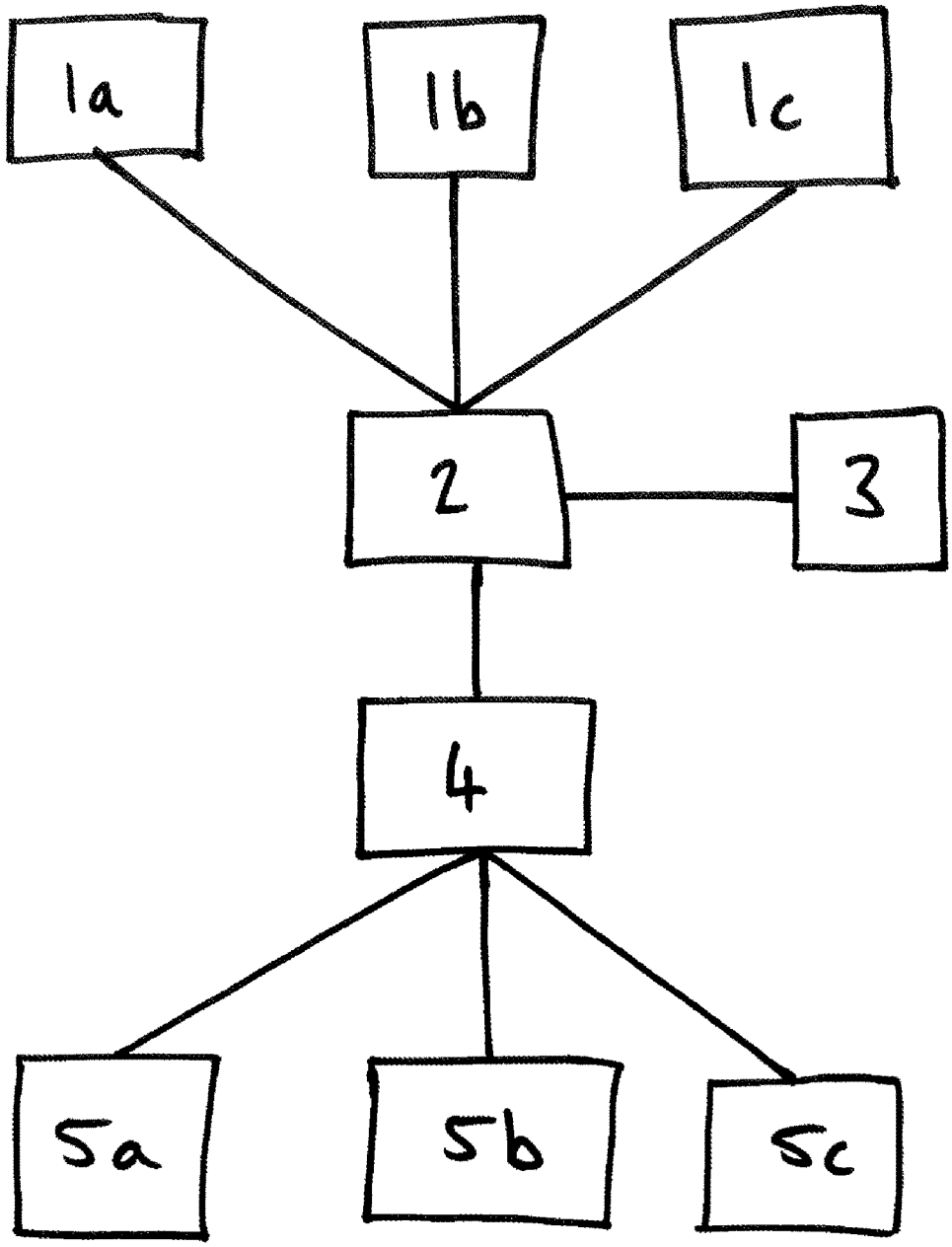
FIG. 10 is a block circuit diagram showing the systems used to control illumination means across multiple reels, as seen in FIG. 7.

FIG. 10 shows an example block circuit diagram used for the control of illumination means 110 on multiple rotatable reels 100, of which in this example there are three, as shown in FIG. 7. The array of reel rotation determining means of each rotatable reel, 1*a*, 1*b* and 1*c* have corresponding illumination means on each reel 5*a*, 5*b* and 5*c*. The rotation data from rotation determining means 1*a*, 1*b* and 1*c* is passed to the central illumination control unit 2. The entertainment machine system control unit 3 passes the desired effect data to the central illumination control unit 3. The central illumination control unit 2 determines the illumination frequency duration, colour and duty cycle data for each rotatable reel 100. This data is then passed to the illumination drive circuit 4. The illumination drive circuit then provides power, in response to the illumination data received from the illumination control unit 2, to the illumination means 5*a*, 5*b* and 5*c*.

The above embodiments are described by way of example only. Many variations are possible without departing from the scope of the invention as defined in the appended claims.

The invention claimed is:

1. A rotatable reel for an entertainment machine, characterized in that the reel is provided with at least one row of circumferentially mounted illumination means, the row aligned with the direction of rotation, wherein the illumination means are operable to be activated at intervals related to the reel rotation frequency; wherein, the activation of the illumination means is controlled by an illumination control unit and wherein, the illumination control unit varies an activation duration of the illumination means in response to the reel rotation frequency or the rate of change of the reel rotation frequency.

2. A reel as claimed in claim 1, wherein the reel comprises an internal framework and a circumferential lateral surface.

3. A reel as claimed in claim 2, wherein the illumination means are mounted to the framework of the reel.

4. A reel as claimed in claim 2, wherein the illumination means are mounted to or over the lateral surface of the reel.

5. A reel as claimed in claim 4, wherein there is a single row of illumination means present upon a reel.

6. A reel as claimed in claim 4, wherein there are two or more rows of illumination means present upon a reel.

7. A reel as claimed in claim 5, wherein each row is provided on opposing peripheral edges of the reel.

8. A reel as claimed in claim 1 wherein, the illumination control unit activates the illumination means at: a frequency equal to a determined reel rotation frequency; a frequency greater than a determined reel rotation frequency; or at a frequency lesser than a determined reel rotation frequency.

9. A reel as claimed in claim 1, wherein the illumination means are separated into groups and the illumination control unit is operable to activate each group independently.

10. A reel as claimed in claim 9, wherein each illumination means in a group is activated simultaneously.

11. A reel as claimed in claim 1, wherein power is delivered to the reel from a power supply external to the reel via a power transfer means.

12. A reel as claimed in claim 11, wherein illumination control signals are transferred through the power transfer means.

13. A reel as claimed in claim 11, wherein the power supply output is varied in response to the illumination control unit or the output light intensity of the illumination means is varied in response to the illumination control unit.

14. A reel as claimed in claim 8, wherein the illumination control unit is operable to determine the reel rotation frequency.

15. A reel as claimed in claim 14, wherein the reel is provided with one or more rotation sensors operable to detect reel rotation.

16. A reel as claimed in claim 14, wherein the illumination control unit drives the illumination means in response to the reel motor drive frequency.

17. An entertainment machine comprising one or more rotatable reels characterized in that the reel is provided with at least one row of circumferentially mounted illumination means, the row aligned with a direction of rotation, wherein the illumination means are operable to be activated at intervals related to the reel rotation frequency; wherein, the activation of the illumination means is controlled by an illumination control unit and wherein, the illumination control unit varies an activation duration of the illumination means in response to the reel rotation frequency or the rate of change of the reel rotation frequency.

18. An entertainment machine as claimed in claim 17, wherein there are multiple reels and each reel displays different visual effects.

19. An entertainment machine as claimed in claim 17, wherein there are multiple reels and the illumination control for the reels is coordinated by a central entertainment control unit.

20. A method of operating a rotatable reel provided with at least one row of circumferentially mounted illumination means, the row aligned with a direction of rotation, the method comprising the steps of: determining a rotation frequency of the rotatable reel; and activating the illumination means at intervals related to the rotation frequency of the rotatable reel; wherein, the activation of the illumination means is controlled by an illumination control unit and wherein, the illumination control unit varies an activation duration of the illumination means in response to the reel rotation frequency or the rate of change of the reel rotation frequency.

21. A method as claimed in claim 20, wherein the method involves determining the reel rotation frequency.

22. A method as claimed in claim 21, wherein the method involves processing data from said rotation sensors to determine the rotation frequency of the spinning reel.

23. A method as claimed in claim 21, wherein the method involves the illumination control unit driving the illumination means in response to the reel motor drive frequency.

24. A method as claimed in claim 21, wherein the method involves activating the illumination means at: a frequency equal to the determined reel rotation frequency; a frequency greater than the determined reel rotation frequency; or a frequency lesser than the determined reel rotation frequency.

25. A method as claimed in claim 24, wherein the method involves varying the activation duration of the illumination means in response to the reel rotation frequency or the rate of change of the reel rotation frequency.

26. A method as claimed in claim 20, wherein the illumination means are separated into groups and each group is activated independently.

27. A method as claimed in claim 26, wherein each illumination means in a group is activated simultaneously.

28. A method of operating a rotatable reel comprising one or more rotatable reels characterized in that the reel is provided with at least one row of circumferentially mounted illumination means, the row aligned with a direction of rotation, the method comprising the steps of: determining a rotation frequency of the rotatable reels; and activating the illumination means at intervals related to the rotation frequency of the rotatable reels; wherein, the activation of the illumination means is controlled by an illumination control unit and wherein, the illumination control unit varies an activation duration of the illumination means in response to the reel rotation frequency or the rate of change of the reel rotation frequency.

29. A method as claimed in claim 28, wherein the illumination means create visual effects that are different on each rotatable reel.

30. A method as claimed in claim 29, wherein the illumination means create the same visual effects across adjacent reels.

* * * * *